United States Patent [19]

Waldrop et al.

[11] 4,285,782

[45] Aug. 25, 1981

[54] METHOD FOR PROVIDING URANIUM WITH A PROTECTIVE COPPER COATING

[75] Inventors: Forrest B. Waldrop, Powell; Edward Jones, Knoxville, both of Tenn.

[73] Assignee: The United States of America as represented by The United States Department of Energy, Washington, D.C.

[21] Appl. No.: 175,813

[22] Filed: Aug. 6, 1980

[51] Int. Cl.[3] ..... C25D 5/32

[52] U.S. Cl. ..... 204/32 R; 204/1.5; 204/37 R; 204/40; 204/52 R; 204/52 Y

[58] Field of Search ..... 204/1.5, 32 R, 37 R, 204/40, 52 R, 52 Y

[56] References Cited

U.S. PATENT DOCUMENTS

| | | | |
|---|---|---|---|
| 2,836,548 | 5/1958 | Gray et al. | 204/1.5 |
| 2,894,885 | 7/1959 | Gray et al. | 204/1.5 |
| 3,147,547 | 9/1964 | Kuebrich et al. | 204/37 R X |

*Primary Examiner*—Delbert E. Gantz
*Assistant Examiner*—William Leader
*Attorney, Agent, or Firm*—Earl L. Larcher; Stephen D. Hamel; Richard G. Besha

[57] ABSTRACT

The present invention is directed to a method for providing uranium metal with a protective coating of copper. Uranium metal is subjected to a conventional cleaning operation wherein oxides and other surface contaminants are removed, followed by etching and pickling operations. The copper coating is provided by first electrodepositing a thin and relatively porous flash layer of copper on the uranium in a copper cyanide bath. The resulting copper-layered article is then heated in an air or inert atmosphere to volatilize and drive off the volatile material underlying the copper flash layer. After the heating step an adherent and essentially nonporous layer of copper is electro-deposited on the flash layer of copper to provide an adherent, multi-layer copper coating which is essentially impervious to corrosion by most gases.

6 Claims, No Drawings

METHOD FOR PROVIDING URANIUM WITH A PROTECTIVE COPPER COATING

This invention was made as the result of a contract with the U.S. Department of Energy.

BACKGROUND OF THE INVENTION

The present invention relates generally to the application of protective coatings on uranium and, more particularly, to a method of applying an impervious protective coating of copper on uranium.

Bare uranium metal is readily corroded by contact with various atmospheric gases and aqueous solutions. In order to utilize uranium metal in most applications it is necessary to provide the uranium article with a protective coating which will inhibit or minimize the deleterious corrosion of the uranium. Also, the joining of the uranium metal to other components or of other metals to uranium metal by brazing, welding, and the like, frequently necessitates the use of a metal coating on the uranium which will facilitate the joining thereof.

Uranium metal has been subjected to various coating materials. Some previously used coating metals, e.g, tin, permit diffusion of the uranium through the coating so as to minimize the value of the coating. Under certain conditions other metals, such as nickel, provide a satisfactory coating but form a very brittle intermetallic with the uranium at temperatures greater than about 480° C. (brazing temperatures) so as to form cracks and crevices therein and thereby to effectively reduce their usefulness as a satisfactory interface for various joining procedures and as a corrosion inhibiter. Copper has been found to provide a suitable protective coating and also to function as a satisfactory interface for various welding procedures. However, the application of copper coatings on uranium as previously practiced has not been satisfactory since blisters formed in the coating which not only weakened the coating but also permitted the corrosion of the underlying uranium to readily occur.

SUMMARY OF THE INVENTION

It is the primary objective or aim of the present invention to provide uranium articles with a copper coating which is virtually non-porous to most corrosion-producing gases and which overcomes blistering problems as heretofore encountered. This goal is achieved by coating the uranium article, after it has been cleaned, deoxidized, and pickled, with a strike layer of relatively porous copper by electroplating the uranium article in a copper cyanide bath. The uranium article with this strike layer is then heated in an air or inert atmosphere to a temperature sufficient to volatilize through the porous strike layer volatile materials trapped beneath the strike layer. The uranium article is then immersed in a bright acid copper bath to provide a thicker and essentially impervious layer of copper on the strike layer. The resulting copper coating is very adherent to the uranium metal and provides satisfactory corrosion resistance for many applications.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

The present invention is directed to a process for electroplating copper directly onto uranium to provide the latter with a multi-layered copper coating which provides satisfactory corrosion protection and which facilitates the joining of uranium articles to one another or to other metals.

Briefly, the uranium article to be coated is subjected to conventional cleaning, oxide removal, etching, and pickling operations prior to the electroplating steps. The cleaned, etched, and pickled uranium article is immersed in a copper cyanide bath for effecting the electrodeposition of a relatively porous and thin film or strike layer of copper on the uranium article. This strike layer is adherent to the uranium metal and is of a thickness in the range of about 0.5 to 5.0 micrometers. The strike layer is evidently porous since no blistering of the layer occurs when the strike coated uranium article is heated in an air or inert atmosphere to a temperature below the melting temperature of copper and sufficient to drive off through the porous flash or strike layer volatile material entrapped under the strike layer. After completing the heating step an adherent and essentially non-porous layer of copper is electrodeposited onto the strike layer of copper by immersing the uranium article in a bright acid copper bath.

The conventional cleaning, etching and pickling steps may be achieved in any suitable manner. For example, the organic material, e.g., oil on the uranium article, may be removed by the use of a suitable solvent, such as trichloroethylene or perchloroethylene. Then, if desired, the surface of the uranium may be scrubbed with pumice or subjected to a grit-blasting operation. The surface oxides may be removed by immersing the uranium article in a nitric acid solution which may contain from about 30–55 vol.% of concentrated nitric acid. After removing the oxides the uranium surface may be etched with an aqueous etching solution containing chloride ions, for example, a concentrated ferric chloride solution. The etched uranium article may then be treated in a pickling solution of nitric acid.

The flash or strike layer of copper is provided in a copper cyanide bath comprising about 20–60 grams/liter of copper cyanide, 30–75 grams/liter of sodium cyanide, 15–60 grams/liter of sodium carbonate, 45–83 grams/liter of Rochelle salt, and 0–18 grams/liter of free sodium cyanide. The electroplating bath used for the strike layer preferably is at a temperature in the range of about 41° to 60° C. and with a current density therein of about 25 to 30 amp/ft$^2$. The uranium articles are immersed in the bath for a duration of about 15 to 20 minutes to provide a copper strike layer in the aforementioned thickness range.

After providing the adherent porous strike layer of copper on the uranium article, it is placed in an oven having an air atmosphere or an inert atmosphere of argon or helium and heated to a temperature in the range of about 200° to 210° C. for a duration of about 0.5 to 0.75 hour. This baking step is effective to volatilize the entrapped volatiles underlying the strike layer. The boiling off of these volatile materials inhibits the formation of blisters in the copper coating as heretofore encountered in the use of copper coatings on uranium articles.

After completing the baking of the uranium article for removing the volatiles underlying the strike layer of copper, the uranium article is provided with a relatively thick and essentially impervious layer of electrodeposited copper in a bright acid copper bath. This bright acid copper bath comprises 195–240 grams/liter of copper sulfate, 41–225 grams/liter sulfuric acid, 20–80 milligrams/liter of chloride ion, such as copper chloride, alkali metal or alkaline earth chloride, or hydrochloric acid. A bath temperature in the range of about 18° to 43° C. is satisfactory with the current density of 18 to 20 amps/ft$^2$. The immersion time for providing a copper layer having a thickness in the range of about 0.0015 to 0.0020 of an inch is about 120 to 130 minutes. After completing the coating steps the uranium article is preferably rinsed in distilled water to remove the plating solution.

A uranium article coated with copper in accordance with the present invention was subjected to an atmosphere of air for 15 months at room temperature. The copper coating was very adherent after this exposure with no indication of corrosion.

It will appear clear that the method of the present invention provides an adherent copper coating on uranium metal articles to provide the articles with surface protection against corrosion and which provides an interface for the joining of the uranium articles to other articles by brazing and the like.

What is claimed is:

1. A method for providing an adherent, protective coating of copper on a uranium article comprising the steps of removing oxides and other surface contaminants from the surface of the uranium article, etching the uranium article in a chloride ion bath, pickling the uranium article in an acid bath, electrodepositing a flash layer of porous copper on the uranium article in a copper cyanide bath, heating the copper-layered uranium article in air or an inert atmosphere to a temperature below the melting temperature of copper and sufficient to volatilize and drive off through the porous flash layer volatile material entrapped under the flash layer, and thereafter electrodepositing on the flash layer of copper an adherent and essentially non-porous layer of copper in a bright acid copper bath.

2. A method for providing a uranium article with an adherent protective coating of copper, as claimed in claim 1, wherein said flash layer of copper is of a thickness in the range of about 0.5 to 5.0 micrometers.

3. A method for providing a uranium article with an adherent protective coating of copper as claimed in claim 2, wherein the copper cyanide bath comprises about 20–60 grams/liter copper cyanide, 30–75 grams/liter sodium carbonate, 45 to 83 grams/liter Rochelle salt, and 0–18 grams/liter free sodium cyanide, wherein the copper cyanide bath is at a temperature in the range of 41° to 60° C. with a current density in the range of 25 to 30 amps/ft$^2$, and wherein the uranium article is immersed in the copper cyanide bath for a duration of 15 to 20 minutes to provide said strike layer.

4. A method for providing a uranium article with an adherent protective coating of copper as claimed in claim 2, wherein the heating of the copper-layered uranium article is at a temperature in the range of 200° to 210° C. for a duration of 0.5 to 0.75 hour.

5. A method for providing a uranium article with an adherent protective coating of copper as claimed in claim 1, wherein the adherent and essentially non-porous layer of copper electrodeposited on said flash layer is of a thickness in the range of about 0.0015 to 0.0020 inch.

6. A method for providing a uranium article with an adherent protective coating of copper as claimed in claim 5, wherein the bright acid copper bath comprises about 195–240 grams/liter copper sulfate, 41–225 grams/liter sulfuric acid, 20–80 milligrams/liter of chloride ion provided by a compound selected from the group consisting of copper chloride, the alkali metal or alkaline earth chlorides or hydrochloric acid wherein the bright acid copper bath is at a temperature in the range of about 18° to 43° C. with a current density in the range of about 18 to 20 amps/ft$^2$, and wherein the uranium article is immersed in the bright acid copper bath for a duration of about 120 to 130 minutes.

* * * * *